United States Patent [19]

Komatsu

[11] 4,187,949

[45] Feb. 12, 1980

[54] DERRICK CRANE WITH WIDE HORIZONTAL SWINGING RANGE OF BOOM

[75] Inventor: Tadaomi Komatsu, Akashi, Japan

[73] Assignees: Kawasaki Jukogyo Kabushiki Kaisha, Hyogo, Japan; Kawasaki Jukogyo Kabushiki Kaisha, Kobe, Japan

[21] Appl. No.: 923,638

[22] Filed: Jul. 10, 1978

[51] Int. Cl.[2] ..... B66C 23/06

[52] U.S. Cl. ..... 212/58 R; 212/66

[58] Field of Search ..... 212/28, 54, 58 R, 66

[56] References Cited

U.S. PATENT DOCUMENTS

| | | | |
|---|---|---|---|
| 453,087 | 5/1891 | Milliken | 212/58 R |
| 957,239 | 5/1910 | McVeigh | 212/54 |
| 1,402,291 | 1/1922 | Harbinger | 212/58 R |
| 1,417,728 | 5/1922 | Gill | 212/58 R |
| 3,446,362 | 5/1969 | Banks, Jr. | 212/58 R X |
| 3,684,104 | 8/1972 | Oda | 212/58 R X |

*Primary Examiner*—Stephen G. Kunin

*Assistant Examiner*—Terrance L. Siemens

*Attorney, Agent, or Firm*—Haseltine, Lake & Waters; Haseltine, Lake & Waters

[57] ABSTRACT

A derrick crane is provided in the hollow interior of its post with a mechanism for preventing mutual rubbing of derricking and hoisting wire cables for the boom, which mechanism comprises a plurality of vertically spaced-apart intermediate turntables having spaced-apart sheaves for guiding and maintaining apart the derricking and hoisting cables and a cable device for so intercoupling a swivel pulley at the top of the post and the turntables that each of the differences between the rotational angles of the swivel pulley and the nearest turntable and between adjacent turntables does not exceed a specific angle (e.g., 120 degrees). The goose neck end of the boom is pivotally mounted on a turning ring rotatably supported around the post. The turning ring is driven in rotation by at least one slewing drum having a diameter smaller than that of the turning ring and coupled to the ring by means of wire cables wound around the ring and drum.

6 Claims, 8 Drawing Figures

DERRICK CRANE WITH WIDE HORIZONTAL SWINGING RANGE OF BOOM

BACKGROUND OF THE INVENTION

This invention relates generally to derrick cranes for loading and unloading cargo, particularly in marine cargo-handling work. More particularly, the invention relates to an improved derrick crane having a derrick boom which can be revolved through 360 degrees either clockwise or counterclockwise from a central position without mutual contacting and rubbing of derricking and hoisting wire cables, and which can be positively driven or held without play due to causes such as gear backlash.

Deck cranes for marine use are most highly developed laborsaving cargo-handling gears but have heretofore been accompanied by the following problems. Since all components of the crane equipment revolve together with the hoisted cargo, the weight of the revolving parts is extremely heavy, and, in the case where deck cranes are installed on a ship, the center of gravity of the ship becomes high, whereby the ship stability is reduced. Furthermore, these cranes are ordinarily limited to maximum load capacity of 30 metric tons at present and possibly 50 metric tons in the future.

SUMMARY OF THE INVENTION

It is an object of this invention to provide a derrick crane which is of relatively light construction and yet is capable of handling extremely heavy cargo loads.

Another object of the invention is to provide a derrick crane in which heavy parts such as motive power means (winches) are disposed at low positions.

Still another object of the invention is to provide a derrick crane whose derrick boom can be revolved through 360 degrees clockwise and counterclockwise for a total range of 720 degrees without mutual contacting and rubbing of the derricking and hoisting cables.

A further object of the invention is to provide a derrick crane in which a turning ring pivotally supporting the inner proximal end or goose neck end of the boom is driven or held in position by one or more small-diameter slewing drums which is or are intercoupled to the turning ring by wire cables wound therearound in stressed condition, whereby the resilience of the wire cables is utilized to eliminate slack and undesirable swinging of the boom such as that due to gear backlash.

According to this invention, briefly summarized, there is provided a derrick crane comprising: an upright derrick post having a hollow interior; a turning ring rotatably supported to rotate around a lower part of the derrick post about a vertical axis; a derrick boom pivotally supported at the inner proximal end thereof on the turning ring in a manner permitting up-and-down derricking movement of the boom; a swivel pulley rotatably supported at the top of the post to swivel freely about a vertical axis and rotatably supporting a plurality of sheaves; a derricking tackle connected between the swivel pulley and the top end of the boom and including a derricking cable passed around a sheave of the swivel pulley, extended downward therefrom to and around a stationary sheave, and wound around a powered winch; a cargo hoisting tackle connected between the top end of the boom and means for suspending a cargo article therefrom and including a hoisting cable passed around another sheave of the swivel pulley, extended downward therefrom to and around another stationary sheave, and wound around a powered winch; a mechanism for preventing mutual contacting of the derricking and hoisting cables comprising a plurality of vertically spaced-apart intermediate turntables rotatably supported in the hollow interior of the post to freely rotate about a vertical axis and located between the swivel pulley and the stationary sheaves, said turntable having spaced-apart sheaves for guiding and maintaining apart the derricking and hoisting cables, and means for so intercoupling the swivel pulley and the turntables that each of the differences between the rotational angles of the swivel pulley and the nearest turntable and between adjacent turntables does not exceed a specific angle thereby to prevent mutual contacting and rubbing of the derricking and hoisting cables; and a mechanism for controllably driving the turning ring comprising at least one slewing drum, motive power means for driving said drum in forward and reverse directions, and cables wound around the turning ring and the slewing drum and operating to transmit torque therebetween.

The nature, utility and further features of this invention will be more clearly apparent from the following detailed description with respect to a preferred embodiment of the invention when read in conjunction with the accompanying drawings, which are briefly described below, and throughout which like parts are designated by like reference numerals.

DETAILED DESCRIPTION

Figure 1:
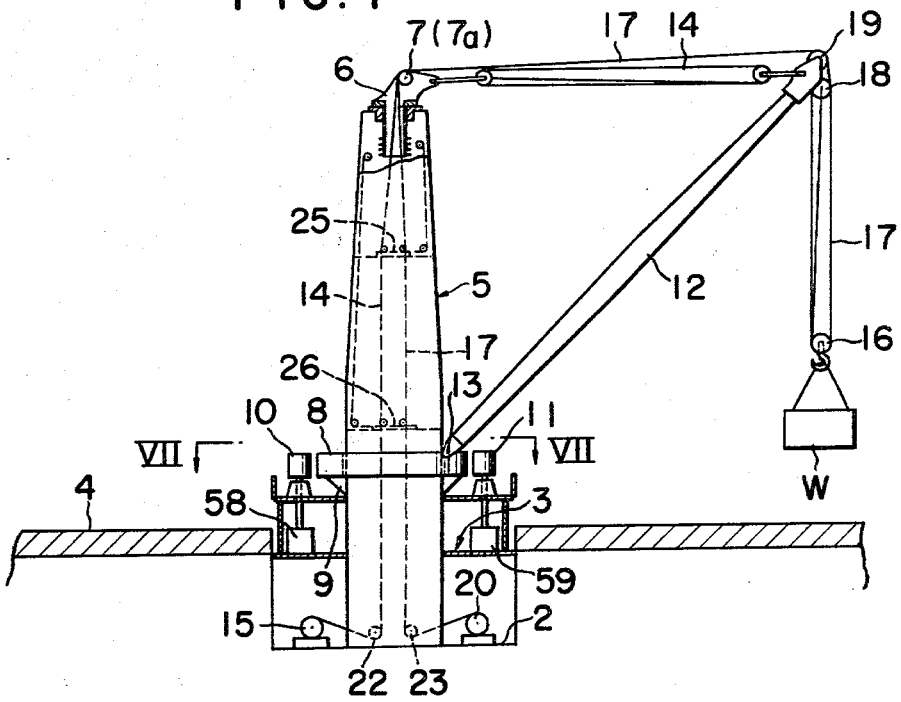
FIG. 1 is a schematic side elevation showing the essential structural organization of one example of the derrick crane according to this invention, which is installed on a ship.
Figure 2:
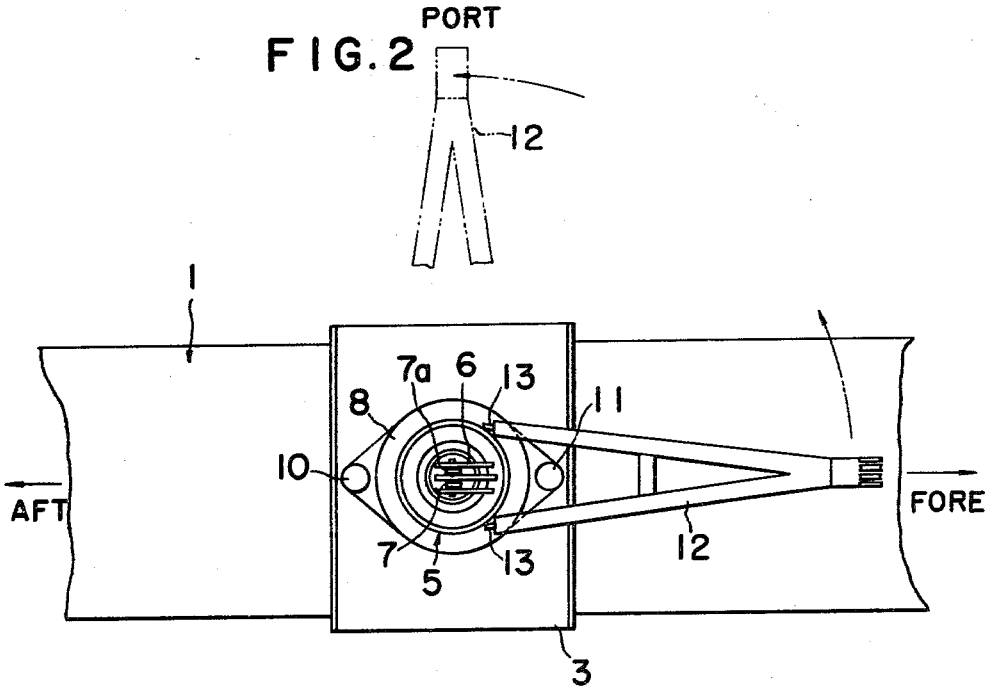
FIG. 2 is a plan view of the same derrick crane.

Referring first to FIGS. 1 and 2, the principal structural parts of the illustrated example of the derrick crane according to the invention, which is installed on board a ship, are as follows. A base 2 is provided in the hull 4 of a ship, and a support structure 3 is rigidly mounted on the base 2. A derrick post 5 is fixedly mounted vertically on the base 2 and the support structure 3 and rotatably supports at its top a swivel pulley 6 adapted to swivel about the vertical centerline of the post 5 and having two sheaves 7 and 7*a*. The derrick post 5 has a hollow interior accommodating intermediate turntables and sheaves as described hereinafter.

A turning ring 8 is rotatably supported by a support 9 fixed to the post 5 at the lower part thereof and turns about the centerline of the post 5. This turning ring 8 is controllably driven in revolving movement by small-diameter slewing drums 10 and 11 through cables as described hereinafter. A derrick boom 12 having the shape of a bipod is pivotally supported at its two inner or goose neck ends 13 on the turning ring 8 so that it can be topped up and down.

This derrick boom 12 is thus topped up and down and held at any topped angle by a derricking tackle comprising a derricking cable 14, sheaves including the above mentioned sheave 7 of the swivel pulley 6, and a topping winch 15 as described hereinafter, the exposed parts of the derricking tackle being strung between the outer or top end of the boom 12 and the swivel pulley 6. A cargo W to be handled by the derrick crane is secured by a hook or the like to a cargo hoist pulley 16 of a cargo hoisting tackle further comprising a cargo hoisting cable 17, sheaves 18 and 19 on the top end of the boom 12, the above mentioned sheave 7*a* of the swivel pulley 6, and a cargo winch 20 as described hereinafter. The winches 15 and 20 and their motive power means (not shown) are installed on the base 2.

An important feature of the derrick crane of this invention is that its derrick boom 12 can revolve through 360 degrees of angle in the clockwise direction and 360 degrees in the counterclockwise direction from the position indicated by chain line in FIG. 2. As described briefly hereinabove, the derricking cable 14 and the cargo hoisting cable 17 are passed over the sheaves 7 and 7*a* of the swivel pulley 6 and stationary sheaves 22 and 23 and are wound on the drums of the winches 15 and 20, respectively. However, unless preventive means according to this invention as described below are provided, there will arise the problem of mutual contacting and rubbing of the cables 14 and 17 when the boom 12 revolves through a large angle either clockwise or counterclockwise.

It will be apparent that when one ends of two originally-parallel strings are fixed and their other ends are rotated about an axis parallel to the two strings, the two strings will fully contact each other at 180 degrees of rotation. In actual practice this contact will occur at a smaller angle of rotation because of the diameter of the strings, whereby, in the case of the derricking and hoisting cables 14 and 17 in the post 5 of one example of practice, this contact occurs when the angle of rotation exceeds about 120 degrees.

According to this invention, there are provided means by which this 120-degree limit is maintained, i.e., not exceeded, and stages of rotation each with this 120-degree limit are successively used thereby to prevent contacting of the two cables 14 and 17 even when the derrick boom 12 revolves through 360 degrees clockwise and 360 degrees counterclockwise, or a total of 720 degrees. The manner in which this is accomplished will now be described with reference to FIG. 3.

Figure 3:
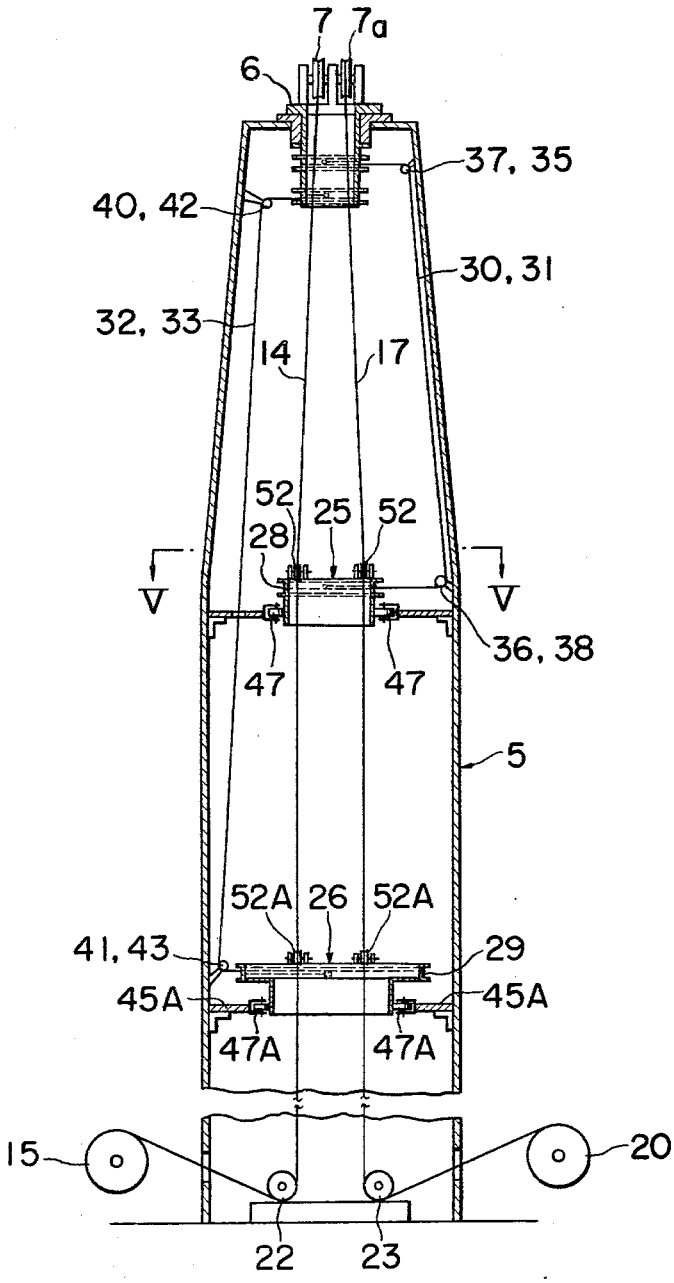
FIG. 3 is a side elevation, with some parts shown schematically and some parts shown in vertical section, showing the derrick post of the same derrick crane and means for preventing mutual rubbing of cables in the post.

FIG. 3 is a schematic side elevation, with parts in vertical section, of the derrick post 5. In the state shown in this figure, the derrick boom 12 is in its port side position, that is, is pointing toward the port side at an angle of 90 degrees relative to the fore-and-aft centerline of the ship as viewed in FIG. 2. As will be apparent from FIG. 1, the swivel pulley 6 revolves in unison with the derrick boom 12 because they are connected by the derricking and hoisting cables 14 and 17. In the instant embodiment of this invention, intermediate turntables 25 and 26 are provided substantially coaxially between the swivel pulley 6 and the aforementioned stationary sheaves 22 and 23. The swivel pulley 6, the intermediate turntable 25, and the intermediate turn table 26 in the instant embodiment revolve respectively at revolutionary speeds which are in the ratio of 3:2:1.

Then, when the swivel pulley 6 revolves clockwise through 360 degrees, the intermediate turntable 25 revolves through 240 degrees, and the intermediate turntable 26 revolves through 120 degrees. Thus, differences each of 120 degrees are successively maintained, whereby the cables 14 and 17 do not contact and rub against each other even when the swivel pulley 6, together with the boom 12, revolves through 360 degrees clockwise and counterclockwise for a total of 720 degrees. It will be apparent that this total revolving angle can be further increased by increasing the number of intermediate turntables.

Figure 4:
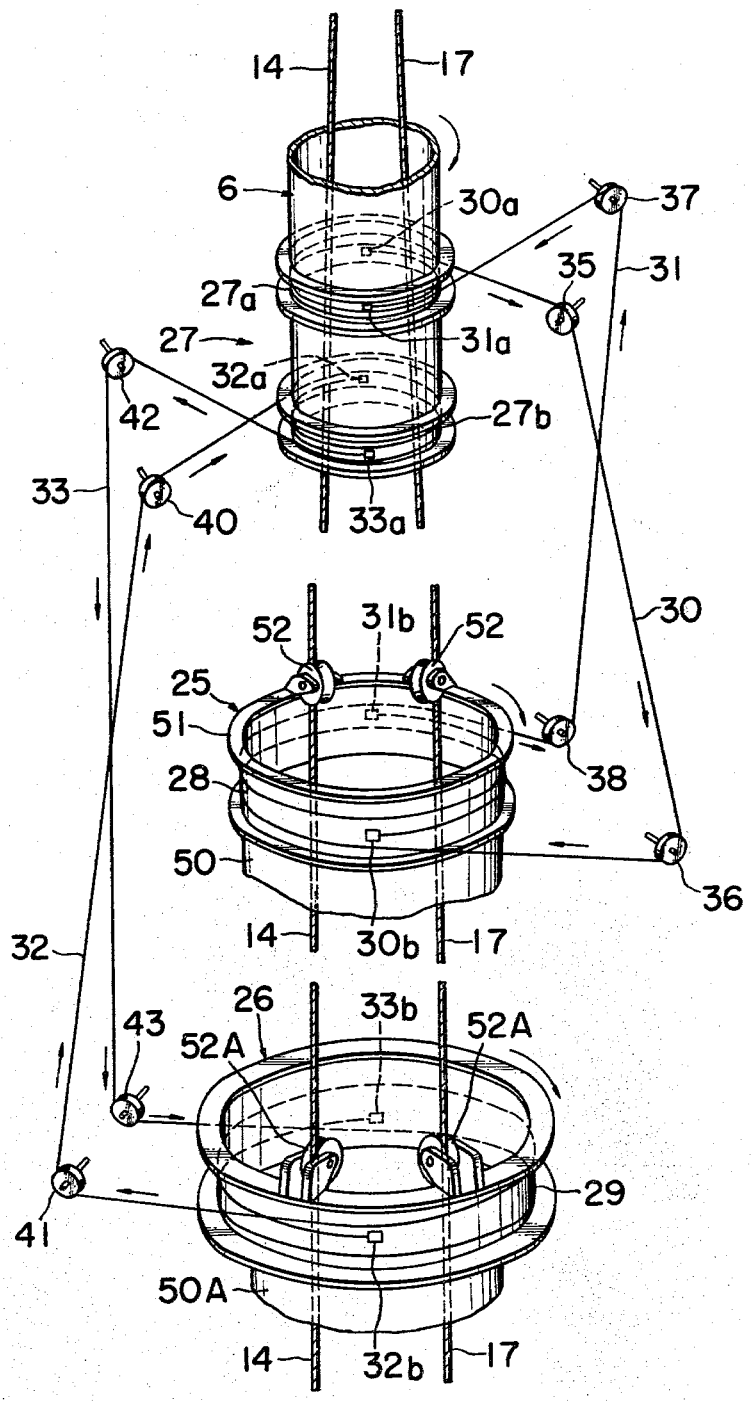
FIG. 4 is a schematic perspective view illustrating one example of intercoupled construction and operation of a swivel pulley at the top of the derrick post shown in FIG. 3 and intermediate turntables.

One example wherein two intermediate turntables are used, and the revolving angle ratios of the swivel pulley 6 and these intermediate turntables is 3:2:1 will be further described in conjunction with FIG. 4. As indicated in FIGS. 3 and 4, the swivel pulley 6 and the intermediate turntables 25 and 26 are provided with respective drums which are respectively designated by the reference numerals 27, 28 and 29, and around which cables 30, 31, 32 and 33 are wound as described below.

A first cable 30 at its one end is wound counterclockwise through more than one turn around a part 27*a* of the drum 27 and anchored at a point 30*a* on the same drum. This cable 30 is passed through lead sheaves 35 and 36 and wound clockwise through more than 240 degrees around the drum 28 of the intermediate turntable 25 and is anchored at its other end at a point 30*b* on the same drum. A second cable 31 is wound at its one end clockwise through more than one turn around the drum part 27*a* and is anchored at a point 31*a* on the drum. This cable 31 is passed through lead sheaves 37 and 38 and wound counterclockwise through more than 240 degrees around the drum 28 of the intermediate turntable 25 and is anchored at its other end at a point 31*b* on the same drum. A third cable 32 is wound at its one end clockwise through more than one turn around a drum part 27*b* of the drum 27 of the swivel pulley 6 and is anchored at a point 32*a* on the drum. This cable 32 is passed through lead sheaves 40 and 41 and at its other end is wound counterclockwise through more than 120 degrees around the drum 29 of the intermediate turntable 26 to be anchored at a point 32*b* on the drum 29. A fourth cable 33 is wound at its one end counterclockwise through more than one turn around the drum part 27*b* and is anchored at a point 33*a* on the drum. This cable 33 is passed through lead sheaves 42 and 43 and is wound at its other end clockwise through more than 120 degrees around the drum 29 to be anchored at a point 33*b* on this drum.

Figure 5:
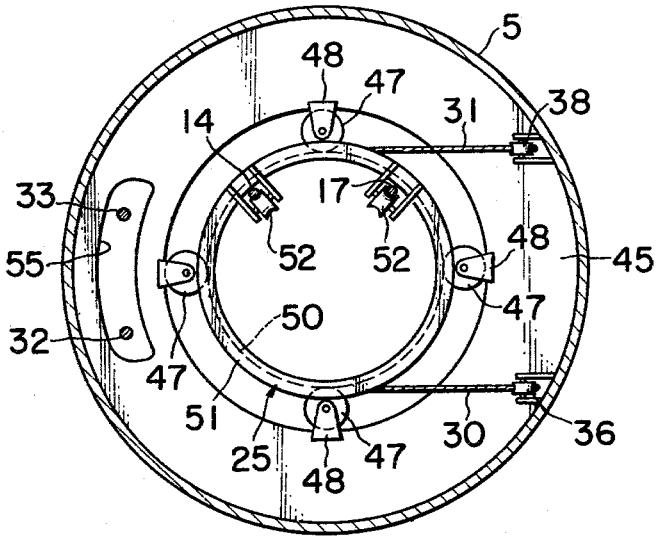
FIG. 5 is a plan sectional view showing an intermediate turntable and taken in the plane indicated by line V—V in FIG. 3 as viewed in the arrow direction.
Figure 6:
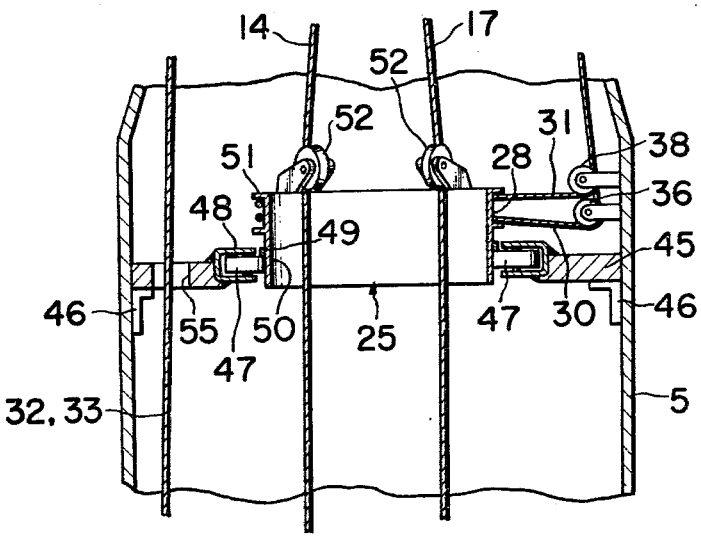
FIG. 6 is a fragmentary elevation, partly in vertical section, corresponding orthogonally to FIG. 5.

The manner of revolvably mounting the upper intermediate turntable 25 in the derrick post 5 is shown in FIGS. 5 and 6. The derrick post 5 has an annular support member 45 fixed to the inner wall thereof by means of brackets 46, and a plurality of guide rollers 47 are supported on the inner periphery of the support member 45 by clevises 48. The turntable 25 has a cylindrical wall 50 which is coaxial with the aforementioned drum 28, and this cylindrical wall 50 is in guided engagement with the guide rollers 47 whereby it can revolve freely. The cylindrical wall 50 has an annular flange 49 resting on the guide rollers 47, whereby the turntable 25 is carried on the support member 45. The turntable 25 is formed with a further flange 51 thereon on which guide sheaves 52 are mounted to guide the derricking and hoisting cables 14 and 17. The aforementioned lead sheaves 36 and 38 are supported by the post 5 as shown. The support member 45 may have a slot 55 for allowing passage of the cables 32 and 33 therethrough.

As shown in FIG. 3, the lower intermediate turntable 26 is supported by supporting means similar to the supporting means as described above in connection with the upper intermediate turntable 25. This supporting means comprises an annular support member 45A, guide rollers 47A and so on, and on the upper surface of the turntable 26 are supported guide sheaves 52A for the cables 14 and 17.

The same operational result as described hereinbefore can be attained by providing the turntable 25 with another drum part and intercoupling this drum part with the drum 29 of the lower turntable 26 with cables. Furthermore, it is possible to use chains or gears and transmission shafts instead of cables.

In addition, in a derrick crane to hoist cargo loads of a number of hundreds of tons, a total of four winches, instead of the two winches 15 and 20 shown, and two each of the hoisting and derricking cables 17 and 14 or a total of four cables will ordinarily be required. This requirement will not give rise to any problems since it can be fulfilled by merely doubling the number of the lead sheaves 7, 7*a*, 52 and 52A.

By the practice of this invention as described above, there is afforded a crane capable of hoisting a cargo load of a number of hundreds of tons, which has heretofore been thought to be impossible for a marine deck crane. As described hereinafter, it is a common knowledge that a ship during loading generally heels or lists approximately 10 degrees to the side hoisting the cargo load. Even when this invention is applied, a torque corresponding substantially to the cargo load being hoisted is imparted to the turning ring 8 on which the goose neck end of the derrick boom 12 pivotally supported.

For example, in the case of a derrick crane hoisting a cargo load of 1,000 metric tons on a ship heeled to 10 degrees with the derrick boom 12 swung out at an angle of approximately 20 degrees relative to the fore-and-aft centerline of the ship, the force exerted on the turning ring 8 will be approximately 980 metric tons due to the cargo load if the ratio of the revolving radius of the derrick boom 12 and the turning ring radius is 6:1, for example. If a gear mechanism were to be used for driving the turning ring 8 under these circumstances, the mechanism would become extremely large even if several pinions were to be mounted on the turning ring 8. Then, because of the relationship between accuracy and size, it would not be possible to assemble the mechanism separately on the ship hull, and the work would become a difficult large-scale operation involving the transforming of the middle part of the ship into a factory for machining.

In contrast, according to this invention, the installation of the driving mechanism for the turning ring 8 can be easily carried out on board the ship since the turning ring 8 and the small-diameter slewing drums 10 and 11 for driving the ring 8 are coupled by cables as described hereinbelow. The drums 10 and 11 are driven by driving means 58 and 59, respectively, which are hydraulic motors, for example, supplied with hydraulic fluid from a common source.

While a chain drive for the turning ring 8 is conceivable in addition to a gear drive, a chain drive is accompanied by the problem of controlling tension on it, and, in the case where forward and reverse drives are required as in the instant derrick crane, impact loads which are even greater than those due to the backlash of gears are imparted to the derrick boom and related parts, whereby a chain drive is not suitable for derrick cranes which hoist heavy cargo loads and gives a great heeling to a ship.

Figure 7:
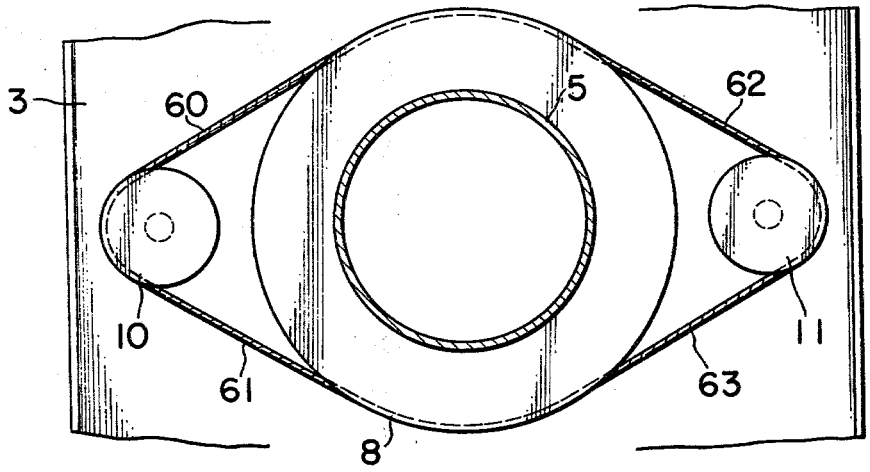
FIG. 7 is a section taken in the plane indicated by line VII—VII in FIG. 1 as viewed in the arrow direction and shows a turning ring for supporting the inner or goose neck end of the derrick boom, small-diameter slewing drums for driving and holding the turning ring, and cables coupling the turning ring and the drums.
Figure 8:
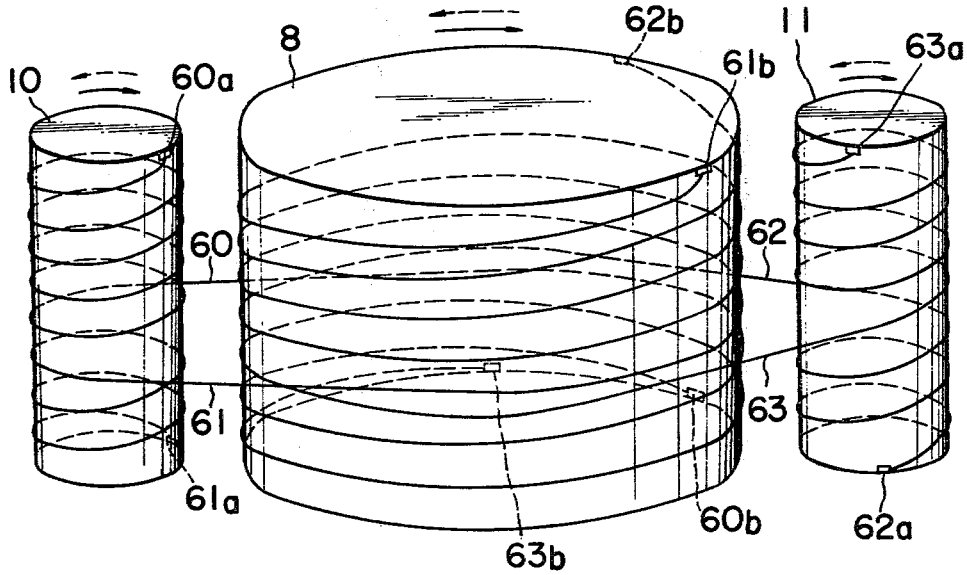
FIG. 8 is a schematic perspective view showing the manner in which the cables for coupling the turning ring and small-diameter slewing drums shown in FIG. 7 are wound and anchored.

While, in the embodiment illustrated in FIGS. 2, 7 and 8, two small-diameter slewing drums 10 and 11 are provided, only one drum should be sufficient for a derrick to handle light cargo loads, whereas three or more drums can be used for a derrick to handle heavy cargo loads.

In the illustrated embodiment, as shown in FIGS. 7 and 8, a first wire cable 60, which is anchored at its one end to the upper part 60*a* of the small-diameter slewing drum 10, is wound clockwise around the drum 10 along a cable guide (such as a guide groove) thereof and led out at approximately the middle part of the drum 10. The wire cable 60 is wound at least one turn clockwise around the turning ring 8 along a cable guide thereof, which is aligned with the path of the cable guide of the slewing drum 10. The other end of the cable 60 is anchored to the lower part 60*b* of the turning ring 8. Another wire cable 61, one end of which is anchored to the lower part 61*a* of the slewing drum 10, is wound counterclockwise around the drum 10 along a cable guide thereof and led out at approximately the middle part of the drum 10 and is wound counterclockwise at least one turn around the turning ring 8 along a cable guide thereof. The other end of the cable 61 is anchored to the upper part 61*b* of the turning ring 8.

Similarly, a wire cable 62, one end of which is anchored to the lower part 62*a* of the other slewing drum 11 is wound counterclockwise around the drum 11 along a cable guide thereof and at least one turn around the turning ring 8 along a cable guide thereof and is anchored at its other end to the upper part 62*b* of the turning ring 8. Also similarly, a wire cable 63, one end of which is anchored to the upper part 63*a* of the slewing drum 11, is wound clockwise around the drum 11 along a cable guide thereof and at least one turn around the turning ring 8 along a cable guide thereof and is anchored to the lower part 63*b* of the turning ring 8.

Referring to FIGS. 7 and 8, when the slewing drums 10 and 11 are simultaneously rotated in the clockwise direction, the cables 60 and 63 are unwound or released from these drums and move onto the turning ring 8. On the other hand, the cables 61 and 62 are wound along the cable guides of these drums from which the cables 60 and 63 have been released. Finally, the cables 60 and 63 are transferred to the turning ring 8, while the cables 61 and 62 are conversely transferred to the drums 10 and 11.

An advantageous feature of this mechanism is that two cables commonly use a single cable guide. More specifically, on each slewing drum, two cables are used or wound and a cable guide of a single-thread-screw shape is provided, while on the turning ring 8, four cables are used or wound and cable guides of the shape of a double-thread screw are provided. Accordingly, the width of the drums can be halved. In the case where one slewing drum is used, the cable guide of the turning ring 8 is of the shape of a single-thread screw. In the case where three or four slewing drums are used, the cable guide of the turning ring 8 assumes the shape of a triple-thread screw or a quadruple-thread screw, and the cable anchoring points on the turning ring are successively staggered.

In this mechanism, the low value of Young's modulus of cables is effective, and their resulting resilient characteristic is utilized. As a result, highly desirable characteristics of the derrick crane from the viewpoint of performance, cost, maintenance, durability, and other aspects are afforded as described hereinbelow.

(1) It is a normal occurrence that when a heavy cargo load is hoisted with a derrick crane installed on board a ship, the hull heels or lists as much as approximately 10 degrees to the side on which load is being hoisted, and constant adjustment by shifting ballast water is carried out to prevent the list of the hull from exceeding 10 degrees. When, with the derrick boom 12 at an angular position of the order of 20 degrees to port or starboard relative to the fore-and-aft centerline of the ship, as viewed in FIG. 2, the hull list angle becomes 10 degrees, a maximum torque is imposed on the turning ring 8.

Referring again to FIGS. 7 and 8, the tensions to which the cables 60 and 63 or 61 and 62 are subjected become a maximum tension or zero tension depending on the direction of the list. In accordance with this invention, each cable is tensioned with the tension load equal to one half of the design maximum load. As a result, when the cable 60, for example, is subjected to its maximum load, it stretches further by an elongation corresponding to half the load, whereby the cable 61 absorbs this elongation of the cable 60 and assumes a no-load state. Accordingly, there is very little slackening of the cables, and therefore the cables will not move out of the cable guides or grooves.

According to this invention, this prestressing or preloading of the cables can be carried out very easily. More specifically, the procedure of pretensioning can be readily carried out by locking the turning ring 8 by locking means, pulling the cable 60, for example, by turning a slewing drum in its winding direction thereby to tension the cable 60, then stringing the loosened cable 61 by means such as a turnbuckle ordinarily fitted at an end of the cable, and carrying out this procedure alternately thereby to impart half loads on all cables. This procedure can be easily accomplished through the use of the driving means 58 and 59.

This is a great advantage of utilizing the resilience of cables, and, even when the heel of the ship changes from port side heel to starboard side heel, for example, during cargo loading work, the backlash due to the clearances in the speed-reducing gears (not shown) of the driving means 58 and 59 is absorbed by the elongation of the cables, whereby oscillation of the top of the derrick boom is prevented. In a deck crane for marine use, in general, the backlash of the gear is greatly conspicuous during slewing for revolution in the reverse direction because of the inertia of the hoisted cargo, and this can become a serious problem and cause for concern in the case of a crane for extremely heavy cargoes. This and other difficulties have been completely eliminated in accordance with this invention. Furthermore, when the turning ring 8 is driven by a large number of slewing drums, substantially uniform loads are imposed on the various equipment, and impacts are absorbed by the elongations of the cables.

(2) Since the turning ring 8 and the slewing drums 10 and 11 are coupled by cables, no difficulties in assembly work are encountered even when they are separately installed on a ship.

(3) Since the turning ring 8 and the slewing drums 10 and 11 require only a few additional work such as the provision of cable guides or cable grooves, the production cost is low.

(4) Since the derrick crane can be installed in an exposed and easily accessible place and manner, it can be easily maintained and, moreover, has high durability.

The above four advantageous features are noteworthy characteristics of this invention. While drive mechanisms depending on cables for equipment have been used on board ships, the mechanisms of this invention has the important characteristic of unvarying tension in the cables due to constantly parallel travel of the cables as a result of the unfolding development of the path of the cable guide of each slewing drum on the turning ring irrespective of the direction in which the slewing drums are rotated.

What is claimed is:

1. A derrick crane comprising: an upright derrick post having a hollow interior; a turning ring rotatably supported to rotate around a lower part of the derrick post about a vertical axis; a derrick boom pivotally supported at the inner proximal end thereof on the turning ring in a manner permitting up-and-down derricking movement of the boom; a swivel pulley rotatably supported at the top of the post to swivel freely about a vertical axis and rotatably supporting a plurality of sheaves; a derricking tackle connected between the swivel pulley and the top end of the boom and including a derricking cable passed around a sheave of the swivel pulley, extended downward therefrom to and around a stationary sheave, and wound around a powered winch; a cargo hoisting tackle connected between the top end of the boom and means for suspending a cargo article therefrom and including a hoisting cable passed around another sheave of the swivel pulley, extended downward therefrom to and around another stationary sheave, and wound around a powered winch; a mechanism for preventing mutual contacting of the derricking and hoisting cables comprising a plurality of vertically spaced-apart intermediate turntables rotatably supported in the hollow interior of the post to freely rotate about a vertical axis and located between the swivel pulley and the stationary sheaves, said turntable having spaced-apart sheaves for guiding and maintaining apart the derricking and hoisting cables, and means for so intercoupling the swivel pulley and the turntables that each of the differences between the rotational angles of the swivel pulley and the nearest turntable and between adjacent turntables does not exceed a specific angle thereby to prevent mutual contacting and rubbing of the derricking and hoisting cables; and a mechanism for controllably driving the turning ring comprising at least one slewing drum, motive power means for driving said drum in forward and reverse directions, and cables wound around the turning ring and the slewing drum and operating to transmit torque therebetween.

2. A derrick crane as claimed in claim 1 in which said mechanism for intercoupling the swivel pulley and the intermediate turntables comprises cable drums of the same number as the turntables, said cable drums being integral and coaxial with the swivel pulley, a cable drum provided integrally and coaxially with each turntable, cables wound around each cable drum of the swivel pulley and around the cable drum of a corresponding one of the turntables thereby to intercouple the two cable drums, and guide means for suitably guiding the cables between the cable drums.

3. A derrick crane as claimed in claim 1 in which said mechanism for controllably driving the turning ring comprises: a first cable anchored at its one end to a part of said slewing drum, wound clockwise as viewed in plan view around the drum, wound more than one turn clockwise around the turning ring, and anchored at its other end to a part of the turning ring; a second cable anchored at its one end to a part of said slewing drum, wound counterclockwise around the drum, wound counterclockwise more than one turn around the turning ring, and anchored at its other end to a part of the turning ring.

4. A derrick crane as claimed in claim 3 in which each of said cables wound around the turning ring is prestressed by a load equal to one half of the maximum design load of that cable.

5. A derrick crane as claimed in claim 3 in which all cables are steel wire ropes.

6. A derrick crane as claimed in claim 1 which is adapted for marine use and is installed with the turning ring somewhat above an open deck of a ship and with bottom of the derrick post and the powered winches disposed below said deck.

* * * * *